United States Patent [19]

Helgesson et al.

[11] 4,250,935

[45] Feb. 17, 1981

[54] METHOD AND AN APPARATUS FOR CROSS-CUTTING TREES

[75] Inventors: Anders T. Helgesson, Åkersberga; Gunnar B. Magnusson, Stocksund; Johan F. Sederholm, Djursholm, all of Sweden

[73] Assignee: Svenska Traforskningsinstitutet, Stockholm, Sweden

[21] Appl. No.: 965,065

[22] Filed: Nov. 30, 1978

[30] Foreign Application Priority Data

Dec. 5, 1977 [SE] Sweden ..... 7713765

[51] Int. Cl.[3] ..... B27L 1/00

[52] U.S. Cl. ..... 144/2 AA; 83/364; 83/371; 144/2 Z; 144/312; 144/309 AC; 364/475

[58] Field of Search ..... 144/2 AA, 2 Z, 3 D, 144/309 AC, 3 Z; 364/475; 83/364, 367, 370, 371

[56] References Cited

FOREIGN PATENT DOCUMENTS

| | | | |
|---|---|---|---|
| 322043 | 3/1970 | Sweden | 144/312 |
| 343391 | 3/1972 | Sweden | 144/312 |
| 353958 | 2/1973 | Sweden | 144/312 |
| 1418201 | 12/1975 | United Kingdom | 144/312 |

*Primary Examiner*—W. Donald Bray
*Attorney, Agent, or Firm*—Young & Thompson

[57] ABSTRACT

A method for cross-cutting trees, where a trunk to be cross-cut is advanced relative to a lopping means for cutting off branches on the trunk. A signal representing the lopping force required is generated and is combined with a signal representing advanced length of the trunk, so that a knot signal representing the presence of knots on the stem is obtained. Said knot signal is used for automatic control of the cutting of the trunk as a function of the presence of knots on the trunk. There is also provided an equipment for performing the method.

20 Claims, 5 Drawing Figures

FIG. 1
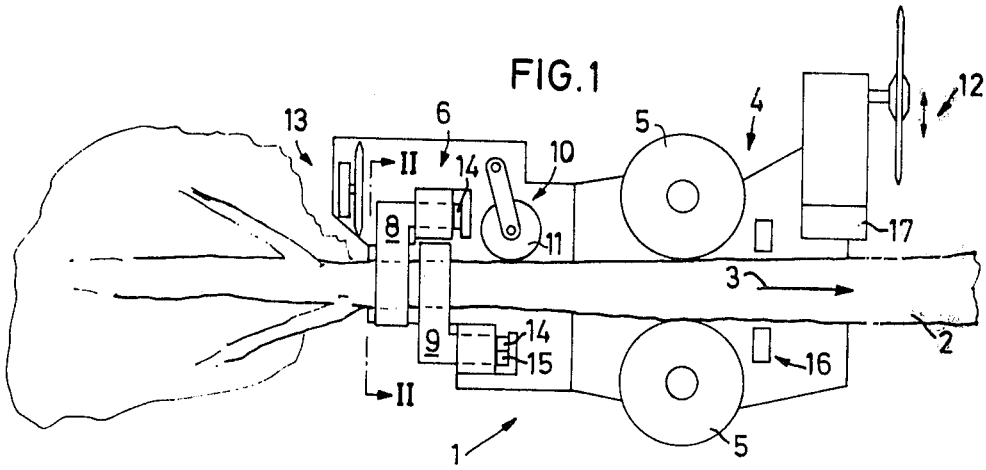
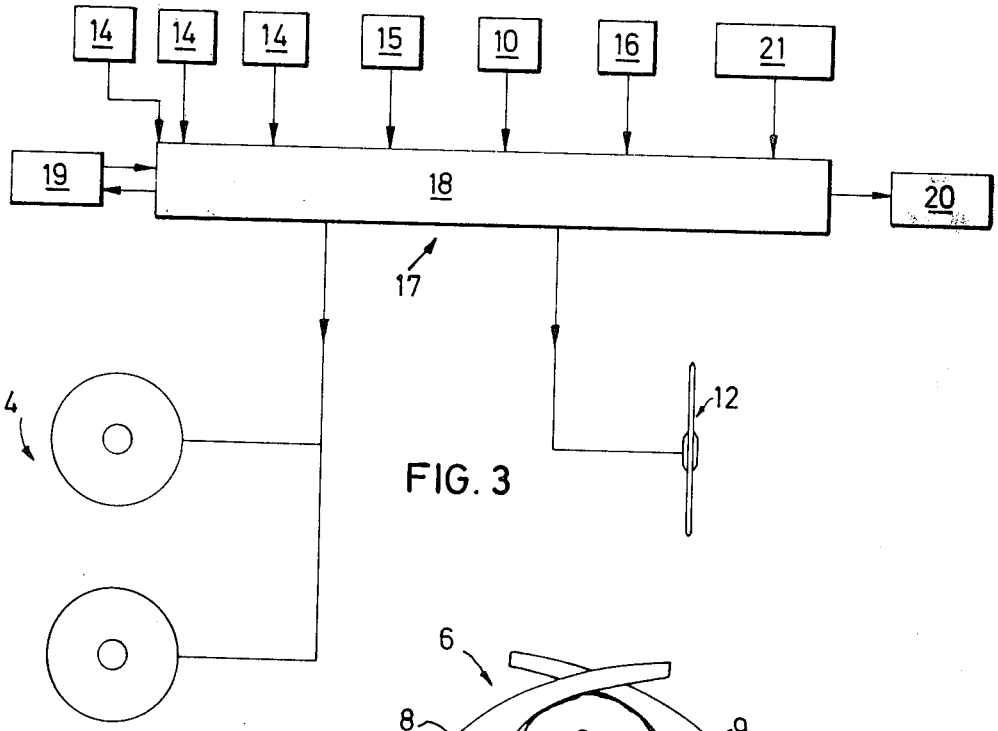
FIG. 3
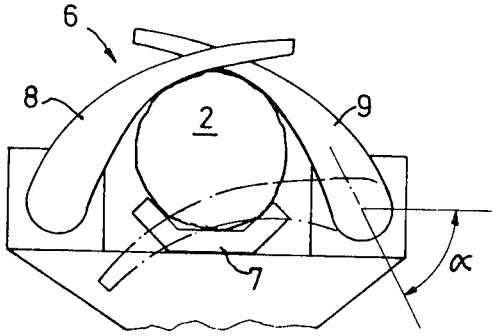
FIG. 2

FIG. 4
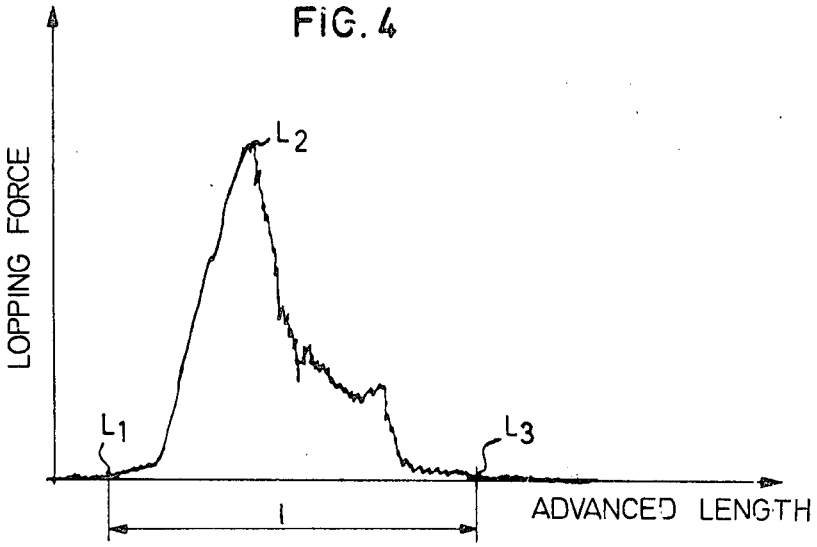
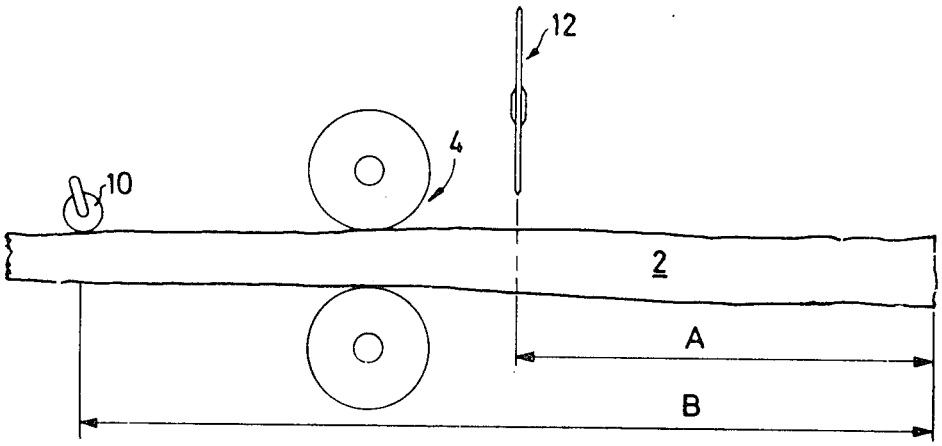
FIG. 5

METHOD AND AN APPARATUS FOR CROSS-CUTTING TREES

The present invention relates to a method for cross-cutting trees, where a feed means provides a relative advance between a tree in its longitudinal direction and a lopping means as well as a cross-cutting means, a "length" signal representing the advance being generated and applied to control means for generating, in response to advance, control signals to the feed means and cross-cutting means. The invention also relates to an apparatus for carrying out this method.

Logging operations in Swedish forestry are generally carried out according to the so-called "assortment system". This system means that the trees are cut up into different assortment ranges in the forest itself, usually saw timber and pulp wood. Where cross-cutting on the tree is to be carried out, the assortment ranges and qualities to be made up are determined when marking for cross-cutting. When marking for cross-cutting it is desirable to take into account a number of factors affecting quality and yield from the logs. Trunk diameter, taper per unit of length, crookedness, total length, number of knots or branches per unit of length and the diameter of the knots are factors which can be measured manually today. Other factors such as rot, compression wood, discoloration and trunk damage must be partially estimated by visual inspection. Marking for cross-cutting is controlled by the same factors also for the cases where it is carried out at the mill or at a landing. The way in which marking for cross-cutting is carried out has great economic importance, since saw timber constitutes a large proportion of the net product from forestry.

Productivity has been increased by mechanizing the processes of lopping and cross-cutting, but this has also resulted in that the operator in the processing unit has a very short time to determine how the marking for cross-cutting of each individual trunk shall be carried out. In order that he shall have time to carry out a visual inspection and perform marking for cross-cutting correctly, it is necessary that as many of the measurable factors as possible are registered and that they automatically influence the marking decision. In the majority of new lopping and cross-cutting installations there is also equipment for measuring the trunk diameter and log length. Equipment and methods for measuring trunk diameter, taper, log length and crookedness are described in the Swedish Pat. Nos. 353,958 and 343,931, for example. Both these patents deal with the use of measuring rollers operating against the trunk for registering the factors mentioned above.

As mentioned, also the number of knots per unit length and their diameter are important factors when marking for cross-cutting, these factors affecting classification of the timber. Among the disadvantages with known methods and apparatus for marking trees for cross-cutting, there is to be found the difficulty of quickly and reliably making allowance for the presence of knots without the rate of production being affected disadvantageously.

The object of the invention is to eliminate this and other disadvantages and to provide a method and apparatus making it possible to take into account the presence of knots for cross-cutting in a considerably simpler and more reliable way.

This is achieved according to the invention in that a lopping force signal representing the cutting force required to cut off the branch or branches in the lopping means at the time is generated and applied to the control means, combining the lopping force signal with the length signal into at least one knot signal representing the presence of knots on the tree trunk, and that the control signals to the advancing and cross-cutting means are emitted as a function of the knot signal.

It is further advantageous for the lopping force signal to be compared with a signal representing known values for shear force per unit of cutting width so that a knot diameter signal is obtained and that thereafter a first knot signal representing the knot size per unit of length is generated. It can furthermore be advantageous to generate a second knot signal representing the number of knots or knot collections per unit of length, and to generate a third knot signal representing the position of knots and/or knot collections relative to the end of the trunk.

As a result of these measures there is the gain that the operator is liberated from the work of localizing the knots and determining their number and size. This determination can be done automatically instead, whereby it will be easier to take into consideration a number of different factors such as diameter, length, taper, knot intensity and knot size, so that the cross-cut is located optimally on the tree stem for utilizing the raw material in the best way.

Equipment normally used for lopping and cross-cutting tree trunks includes an advancing means, arranged to provide an advancing movement of a tree trunk in its axial direction relative to a lopping apparatus and a cross-cutting means, there being a control means arranged for receiving a length signal from the advancing means and representing an advance of length, the control means then generating length advance responsive control signals and transmitting these signals to the advancing means and the cross-cutting means.

A suitable apparatus for carrying out the method according to the invention can for example be obtained by modifying such known equipment so that the lopping means is provided with at least one transducer for generating a lopping force signal representing the shearing force required to cut the branch or branches which are in the lopping means at the time, that the control means is arranged to receive the lopping force signal and to combine it with the length signal into at least one knot signal representing the presence of knots on the tree trunk, and that the control means is arranged to transmit the control signals to the advancing means and lopping means as a function of the knot signal. A conventional apparatus for lopping and cross-cutting thus needs only to be supplemented by relatively few details to provide an apparatus according to the invention.

The invention is explained in more detail in the following with the help of an embodiment shown in the attached drawings, where FIG. 1 shows schematically from above the essential parts of an apparatus according to the invention, FIG. 2 shows schematically a section along the line II—II of FIG 1, FIG. 3 shows a block diagram for an apparatus according to the invention, FIG. 4 shows the lopping force signal at a knot, and FIG. 5 shows a view similar to FIG. 1 in a simplified form.

For studying trees for cross-cutting, and for cross-cutting there is used according to the invention a work unit 1 as shown in FIG. 1, where only the parts essential to the invention have been included. The work unit comprises a lopper-cutter, constructed in the conventional way, which has been modified in certain respects. The work unit 1 can be of the stationary type or be placed on a movable basic unit of the type usually to be found in forestry work. Such basic units are well-known to one skilled in the art, and therefore do not need to be more closely described here. Feeding apparatus (not shown) in the form of a crane or the like is also associated with the work unit 1. Different types of equipment for collecting cut timber can also be involved. The work unit 1 is suitably tended by an operator whose work area can be situated in direct proximity to the work unit 1 or the basic unit, or at some other suitable place.

As is apparent from FIG. 1, a felled tree 2 is advanced with its root end first in its axial direction, i.e. in the direction of arrow 3. Advancing takes place with the help of an advancing means 4 with two driven advancing rolls 5, one on either side of the trunk 2. Branches are removed from the trunk with the help of a lopping means 6. The lopping means 6 is suitably provided with lopping tools embracing the trunk, at least two and often more than two. The lopping tools can comprise curved knives or lopping knives which are assembled together to form so-called knife mats which are suspended in movable cantilevers, or milling tools etc. Lopping is carried out either by pulling the trunk through the lopping means or by moving the lopping apparatus along the trunk. A combination of both these movements is also conceivable. As is apparent from FIG. 2, the lopping means 6 shown in the embodiment here is provided with a fixed lower knife 7, having a suitable curvature for the purpose, and two curved pivotably mounted knives 8 and 9 which are pivotable in the plane of the drawing in FIG. 2.

Between the advancing means 4 and the lopping means 6 there is an advance measurement means 10, with the help of which the advance of the trunk is measured. In the case shown here, a measuring roller 11 contacting the stem is connected to an electrical pulse transmitter (not shown), but any of a number of other advance measurement means available on the market can be used.

After the advancing means 4, there is a cross-cutting means 12 for cutting the trunk into desired lengths. In conjunction with the lopping means 6 there is a crown cutter 13 for cutting off the part of the tree trunk which is not going to be taken through the work unit 1.

For processing, the tree 2 is placed with its root end between the advancing rolls 5. The lopping knives 8 and 9 are brought into contact with the trunk and the tree is advanced so that the branches are cut off. The lopping knives are kept against the trunk all the time with the help of spring force or in some other way. Meanwhile, the distance advanced is registered with the help of the advance measurement means 10.

The lopping apparatus 6 is arranged to generate a lopping force signal, representing the shear force required to cut off the branch or branches which are in the lopping means at the time. This can be accomplished in a number of different ways. In the embodiment shown here, there is on each of the lopping tools at least one transducer for generating a lopping force signal representing the shearing force required to cut off the branch or branches contacting that particular lopping tool at that moment. Accordingly, there is a lopping force transducer 14 associated with each of the knives 8 and 9, while the knife 7 is similarly provided with a lopping force transducer (not shown). These lopping force transducers are suitably so applied and disposed that they register the force only in the advancing direction of the trunk. Instead of registrating the shear force separately for each of the lopping tools, it is also possible to make the lopping means 6 in such a way that the lopping force can be measured centrally for the entire lopping means with the help of one or more suitably placed transducers. For simplicity, the lopping force transducers should be arranged in such a way that torque or bending moments, or side forces due to the lopping forces are not transmitted to the transducer, although other mounting is possible.

As is usual, the work unit 1 is suitably equipped with apparatus for determining the trunk diameter. A number of different designs are available here, depending on requirements. In the embodiment shown here, there is a diameter transducer 15 coupled to the lopping knife 9 to sense its turning position. From the neutral position shown with dashed lines in FIG. 2 the lopping knife 9 is turned an angle $\alpha$ which is proportional to the trunk diameter. The diameter transducer 15 can comprise a potentiometer or the equivalent, for example.

There is a root signal transducer 16 between the advancing means 4 and the lopping means 12, this transducer coacting with the advance measurement means 10 and having the task of transmitting a signal when the end of the trunk passes. The root signal transducer 16 can be of some suitable design such as one using a photocell.

A control unit 17 is arranged to transmit control signals, in response to length advance, to the advancing means and cutting means so that the stem is cut at the desired places. The control unit 17 is here placed on the work unit 1, but it can naturally be just as well placed in some other suitable location, e.g. in connection with the operator's operating area.

As is apparent from FIG. 3, the lopping force transducers 14, diameter transducer 15, advance measurement means 10 and the root end signal transducer 16 are connected to a computer unit 18 included in the control unit 17. A memory 19 and a registering unit 20 are also connected to the computer unit 18. Further, the advancing means 4 and the cross-cutting means 12 are connected to the computer unit 18.

In the computer unit 18, which suitably has a clock function, the signals from the different transducers are processed to actual values for a number of different parameters. Desirable parameters are those such as length, diameter, taper, number of knots or knot collections per unit of length, the location of knots or knot collections in relation to the end of the trunk, the knot area per unit length, knot diameter etc. Criterion values for the desired parameters are suitably programmed into the memory 19. For some parameters there can be several criterion values having different priorities. The computer unit 18 continuously compares the programmed criterion. values with the actual values computed. When the actual values agree with the most suitable criterion values, signals are transmitted from the control unit to the advancing means 4 and the cross-cutting means 12 so that the cut is optimally located in respect of the desired parameters.

Via his operating panel 21 the operator can suitably influence the work of the computer unit 18 by introducing different types of corrections into the unit. Such a correction factor can, for example, relate to the kind of tree being processed at the moment. Other types of correction factors can also be incorporated, such as for the time of year, air temperature, type of stand, rot, trunk damage, trunk unevenness, compression wood, etc. It can also be expedient to select such an embodiment that the operator can completely or partially suppress the control unit 17, e.g. so that he himself can decide the length to be cut. The actual values of the different parameters can be transferred to the register unit 20 and stored here, possibly together with other desirable information, e.g. the kind of tree and the processing time. In this way there is the possibility of checking, after work has been finished, on how evaluation for cross-cutting has been carried out.

The presence of one or more branches in the lopping means 6 is indicated by an alteration in the signal level from the transducers associated with the lopping means 6. With knowledge of the advancement of the trunk it will thus be possible to determine the extent of the knots in the axial direction of the trunk, which also enables an estimation as to where the knots are in relation to the trunk end, and on how large a portion of the trunk length there are knots. By calibration, it is possible to determine the size of the force represented by a certain signal level from the lopping force transducers 14. By comparison with an empirically determined relationship between cutting force and knot size, it will thus be possible to determine the knot size in the computer unit 18.

In FIG. 4 there is schematically shown an example of how the lopping force signal can vary as a function of advanced length when a knot is encountered. From having been substantially zero at $L_1$ in front of the knot, the lopping force increases to a maximum at $L_2$ and then becomes substantially zero at $L_3$. The distance 1 between $L_1$ and $L_3$ thereby corresponds to the extent of the knot along the stem.

The evaluation of knot size based on the lopping force signal can be done in a number of different ways. One possibility is to determine the maximum value of the lopping force signal in a knot or collection of knots, and to use this value for determining the knot size at the place in question. Another possibility is to determine the length derivative of the lopping force signal, i.e. derivative with relation to the advanced length, and use this for determining the knot size. A third possibility is to determine the length integral of the lopping force signal, i.e. the integral with respect to the advanced length, and use this for determining the knot size. A fourth possibility is to calculate the knot size on the basis of the knot length. The methods mentioned can naturally be modified in different ways according to requirements, or be replaced by other methods of equivalent value.

So as to obtain as long a time as possible for the necessary calculations in the computer unit 18, and to give the computer unit as many measuring values as possible to compute, it is expedient that measurement on the trunk is performed as far ahead of the cutting location as is possible. The lopping tools and other places where measurement takes place should therefore be placed at the greatest possible distance from the cutting location. This is indicated schematically in FIG. 5, where advancing of a tree trunk is in progress. The trunk has been advanced past the cutting location a distance A, corresponding to the length of the log, simultaneously as an estimation can take place over the length B, the estimating length. The longer length B can be made, the more reliably the length A can be selected, while taking into account a desired number of different parameters.

According to the invention, it will thus be possible to automatically examine the tree stem for cross-cutting while taking into account the presence of knots on the trunk. The log length A can thus be selected as a function of how the knots are distributed on the trunk, which means that examination for cross-cutting can be carried out with regard to set requirements for diameter, length and quality. For example, it is possible to place the cut in a ring of knots. Cutting of the trunk into different assortments can thus take place without the operator needing to interfere.

The result will be that there is the possibility of using the knottiness of the trunk as a quality factor.

The embodiment described here can naturally be varied in a number of different respects within the framework of the invention. For example, the number of transducers of different types can be varied as desired, and the control unit can be designed in some other way, e.g. by modifying the tasks given to the computer unit 18.

What I claim is:

1. An apparatus for cutting tree trunks to length, comprising in combination lopping means for cutting off branches from the trunks, cutting means for cutting off the trunk, advancing means for moving the trunk lengthwise past the lopping means and the cutting means, means for measuring the lengthwise movement of the tree trunk, a control unit receiving from said measuring means a length signal representing the length advance of the trunk and generating in response to length advance control signals for the advancing means and for the cutting means, at least one transducer that measures the cutting force applied by the lopping means to cut off the branch or the branches momentarily engaging the lopping means, said transducer generating a lopping force signal representative of that cutting force, said control unit having an input for the lopping force signal and combining said lopping force signal with the length signal into at least one knot signal representing the presence of knots on the tree trunk, said control unit transmitting said control signals to the advancing means and to the cutting means as a function of the knot signal thereby to cut off the trunk at locations that are well chosen relative to the locations of the Knots.

2. Apparatus as claimed in claim 1, and means whereby the control unit generates a knot diameter signal by comparison between the lopping signal force and a signal representing the relationship between cutting force and cutting width and generates with the help of the knot diameter signal a first knot signal representing the knot size per unit length.

3. Apparatus as claimed in claim 1, and means whereby the control unit generates a second knot signal representing the number of knots per unit length.

4. Apparatus as claimed in claim 3, and means whereby the control unit generates a third knot signal representing the position of knots relative to the stem end.

5. Apparatus as claimed in claim 1, and at least one trunk diameter transducer that generates a diameter signal, the control unit including means to sense the diameter signal and to combine the diameter signal with the knot signal for selecting the location of the cut.

6. Apparatus as claimed in claim 1, and a memory in the control unit for storing criterion values for signals generated by the control unit.

7. Apparatus as claimed in claim 1, and means to manually reset the control unit for varying the control functions.

8. A method for cutting tree trunks to length, comprising the steps of advancing a tree trunk in its lengthwise direction while generating a length signal representing length advance, performing a lopping operation while generating a lopping force signal representing the cutting force required to cut off the branch or the branches momentarily engaged by a lopping means, combining the length signal and the lopping force signal into at least one knot signal representing the presence of knots on the tree trunk, using the length signal and the knot signal for selecting a location at which to cut the tree trunk, and cutting the tree trunk at said location.

9. A method as claimed in claim 8, and comparing the lopping force signal with a signal representing known values for cutting force per unit of cutting width so that a knot diameter signal is obtained, and subsequently generating a first knot signal representing knot size per unit length.

10. A method as claimed in claim 9, and determining the maximum level of the lopping force signal, and using said maximum level for determining the knot size.

11. A method as claimed in claim 9, and determining the length derivative of the lopping force signal, and using said length derivative for determining the knot size.

12. A method as claimed in claim 9, and determining the length integral of the lopping force signal, and using said length integral for determining the knot size.

13. A method as claimed in claim 9, and determining the duration of the lopping force signal, and using said duration for determining the knot size.

14. A method as claimed in claim 8, and generating a second knot signal representing the number of knots per unit length.

15. A method as claimed in claim 14, and generating a third knot signal representing the position of knots relative to the trunk end.

16. A method as claimed in claim 8, and generating a diameter signal representing the trunk diameter, combining said diameter signal with the knot signal, and selecting the cutting location according to said combination of the diameter signal and the knot signal.

17. A method as claimed in claim 16, and combining the diameter signal with the length signal, using the combined signal to generate a taper signal representing the taper per unit length, combining the taper signal with the knot signal, and using the latter combination to select the cutting location.

18. A method as claimed in claim 8, and comparing the actual value of the signals with at least one criterion value for the signals, generating comparative signals from said comparison, and transmitting signals to actuate at least one of the advance and cutting means when the actual values coincide with predetermined criterion values.

19. A method as claimed in claim 18, and giving to the criterion values an order of priority depending on their mutual importance.

20. A method as claimed in claim 19, and introducing at least one correction value for the kind of tree being processed and the presence of stem damage into the generation of said first knot signal.

* * * * *